US010816228B2

(12) United States Patent
Liu et al.

(10) Patent No.: US 10,816,228 B2
(45) Date of Patent: Oct. 27, 2020

(54) AIR-CONDITIONING OUTDOOR MACHINE

(71) Applicant: Beijing Xiaomi Mobile Software Co., Ltd., Beijing (CN)

(72) Inventors: Tie Liu, Beijing (CN); Jicheng Luo, Beijing (CN); Fei Duan, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/024,030

(22) Filed: Jun. 29, 2018

(65) Prior Publication Data

US 2019/0003729 A1 Jan. 3, 2019

(30) Foreign Application Priority Data

Jun. 29, 2017 (CN) ..... 2017 1 0515406

(51) Int. Cl.
*F24F 1/56* (2011.01)
*F24F 1/58* (2011.01)
(Continued)

(52) U.S. Cl.
CPC ..... *F24F 1/56* (2013.01); *F24F 1/58* (2013.01); *F24F 1/10* (2013.01); *F24F 1/38* (2013.01); *F24F 1/54* (2013.01)

(58) Field of Classification Search
CPC ..... F24F 1/56; F24F 1/58; F24F 1/10; F24F 1/38; F24F 1/54; F24F 13/20;
(Continued)

(56) References Cited

U.S. PATENT DOCUMENTS 4,100,764 A * 7/1978 Murano ..... F24F 1/04 62/262
4,736,598 A * 4/1988 Sameshima ..... F24F 1/022 62/259.1
(Continued)

FOREIGN PATENT DOCUMENTS

CN 202993409 U 6/2013
CN 203718976 U 7/2014
(Continued)

OTHER PUBLICATIONS

Combined Chinese Office Action and Search Report dated May 7, 2019 in Chinese Patent Application No. 201710515406.7 (with English translation of Office Action and English translation of Category of Cited Documents), citing documents AO, AP and AQ therein, 18 pages.
(Continued)

*Primary Examiner* — Hiwot E Tefera
(74) *Attorney, Agent, or Firm* — Oblon, McClelland, Maier & Neustadt, L.L.P.

(57) ABSTRACT

The disclosure relates to an air-conditioning outdoor machine. The air-conditioning outdoor machine includes a bottom housing, a wall housing enclosed by the bottom housing, a top sub-plate provided at a top of the wall housing and a top cover removably mounted on the top sub-plate, where the bottom housing, the wall housing, and the top sub-plate define a accommodating space of an internal structure of the air-conditioning outdoor machine.

8 Claims, 2 Drawing Sheets

(51) Int. Cl.
*F24F 1/38* (2011.01)
*F24F 1/10* (2011.01)
*F24F 1/54* (2011.01)

(58) Field of Classification Search
CPC ..... F24F 2013/202; F24F 2013/205; F24F 2013/207; F24F 1/06
USPC ..... 312/100, 101; 62/259.1
See application file for complete search history.

(56) References Cited

U.S. PATENT DOCUMENTS 4,911,234 A * 3/1990 Heberer ..... F24F 1/022 165/125
5,307,849 A 5/1994 Nelson
5,975,113 A * 11/1999 Haining ..... F24F 13/222 137/268
6,085,537 A 7/2000 Takeda et al.
6,405,552 B1 * 6/2002 Hubert ..... F24F 13/22 62/285
7,281,389 B1 * 10/2007 O'Brien ..... F24F 1/04 62/272
2003/0217563 A1 11/2003 Wendt et al.
2004/0099001 A1 5/2004 Wendt et al.
2005/0109055 A1 * 5/2005 Goetzinger ..... F24F 13/222 62/291
2005/0204767 A1 9/2005 Norrell et al.
2007/0163295 A1 * 7/2007 Martin, Sr. ..... F24F 1/08 62/507
2007/0169501 A1 * 7/2007 Rios ..... F24F 13/222 62/286
2008/0098899 A1 * 5/2008 Uchida ..... A61L 9/14 96/255
2009/0114376 A1 * 5/2009 Ishida ..... F24F 1/38 165/104.31
2009/0120118 A1 * 5/2009 Yoon ..... F24F 3/14 62/259.1
2009/0158935 A1 * 6/2009 Kim ..... F24F 13/20 96/189
2010/0294466 A1 11/2010 Shimaoka et al.
2013/0032310 A1 * 2/2013 Jaena ..... F28D 15/02 165/104.25
2014/0091692 A1 * 4/2014 Miwa ..... F24F 13/20 312/285
2014/0298844 A1 * 10/2014 Luo ..... F24F 1/36 62/275
2015/0013371 A1 * 1/2015 Cho ..... F24F 3/1405 62/272
2015/0121933 A1 * 5/2015 Yamaguchi ..... F24F 1/16 62/275
2015/0301560 A1 * 10/2015 Garland, Sr. ..... G03B 17/568 455/575.8
2015/0316279 A1 * 11/2015 Kubono ..... F24F 1/56 62/515
2016/0195343 A1 * 7/2016 Jeung ..... F28F 9/007 165/162
2016/0273788 A1 * 9/2016 Cho ..... F24F 1/38
2017/0248330 A1 * 8/2017 Nezu ..... F24F 1/38
2018/0372344 A1 * 12/2018 Abukawa ..... F24F 1/40
2019/0293307 A1 * 9/2019 Jones ..... F24F 1/58

FOREIGN PATENT DOCUMENTS

CN 204648517 U 9/2015
EP 2 455 674 A1 5/2012
EP 2 767 768 A1 8/2014
WO WO 2011/052318 A1 5/2011
WO WO 2016/136529 A1 9/2016

OTHER PUBLICATIONS

Extended European Search Report dated Nov. 19, 2018 in European Patent Application No. 18180309.9, citing documents AA through AD, and AO through AR therein, 8 pages.

* cited by examiner

AIR-CONDITIONING OUTDOOR MACHINE

CROSS REFERENCE TO RELATED APPLICATIONS

This application is based on and claims priority to Chinese Patent Application No. 201710515406.7, filed on Jun. 29, 2017, the entire contents of which are incorporated herein by reference.

TECHNICAL FIELD

The present disclosure relates to the field of electronics, and more particularly to an air-conditioning outdoor machine.

BACKGROUND

An air-conditioning outdoor machine may be integrally combined with a top cover and a wall housing, and may include a junction box, a connecting air valve and other parts that are provided on an external side surface of the wall housing, thereby affecting an appearance of the air-conditioning outdoor machine. Further, since the air-conditioning outdoor machine is typically mounted on an outdoor wall in a suspended manner, the integrated structure of the top cover and the wall housing may significantly complicate any required maintenance and thus bring relatively great difficulties to maintenance personnel. Also, because the junction box is exposed to the weather over a long time, a relatively major potential safety hazard may exist.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide an air-conditioning outdoor machine including a bottom housing; a wall housing enclosed by the bottom housing; a top sub-plate provided at a top of the wall housing; and a top cover removably mounted on the top sub-plate, wherein the bottom housing, the wall housing, and the top sub-plate define an accommodating space of an internal structure of the air-conditioning outdoor machine.

According to an aspect, the top sub-plate comprises an observation window that is configured to provide a view of the accommodating space, and wherein at least part of the observation window is opposite to a fan inside the air-conditioning outdoor machine.

According to another aspect, the top sub-plate further comprises a cable-control-arrangement-structure for accommodating connecting wires, and the observation window and the cable-control-arrangement-structure are located on both ends of the top sub-plate, respectively.

According to yet another aspect, the top sub-plate further comprises a fan-support-assembling-region for assembling a fan support structure, and wherein the fan-support-assembling-region is located between the observation window and the cable-control-arrangement-structure.

According to yet another aspect, the fan-support-assembling-region comprises a cooperating portion and a position-limited guiding portion close to the cooperating portion.

According to yet another aspect, at least one flow guiding groove is provided at an edge of the top sub-plate.

According to yet another aspect, a plurality of flow guiding grooves are respectively provided at a corner and a side edge of the top sub-plate.

According to yet another aspect, a flow guiding plate is provided at a circumferential side of the top sub-plate.

According to yet another aspect, the cable-control-arrangement-structure is an accommodating recess depressed toward the bottom housing.

According to yet another aspect, the air-conditioning outdoor machine further comprises a support structure connected between the bottom housing and the top sub-plate.

In an example, the support structure is a sheet metal plate.

According to an aspect, the support structure, the bottom housing, the wall housing, and the top sub-plate define a space for accommodating a compressor.

It is to be understood that both the foregoing general description and the following detailed description are illustrative and explanatory only and are not restrictive of the present disclosure.

BRIEF DESCRIPTION OF DRAWINGS

The accompanying drawings, which are incorporated in and constitute a part of this specification, illustrate aspects consistent with the disclosure and, together with the description, serve to explain the principles of the disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

The term used in the present disclosure is for the purpose of describing a particular example only, and is not intended to be limiting of the present disclosure. The singular forms such as "a", 'said", and "the" used in the present disclosure and the appended claims are also intended to include multiple, unless the context clearly indicates otherwise. It is also to be understood that the term "and/or" as used herein refers to any or all possible combinations that include one or more associated listed items.

Some examples of the present disclosure will be detailed below in combination with accompanying drawings. In the case of no conflicts, the following examples and features of the examples may be combined with each other.

Figure 1:
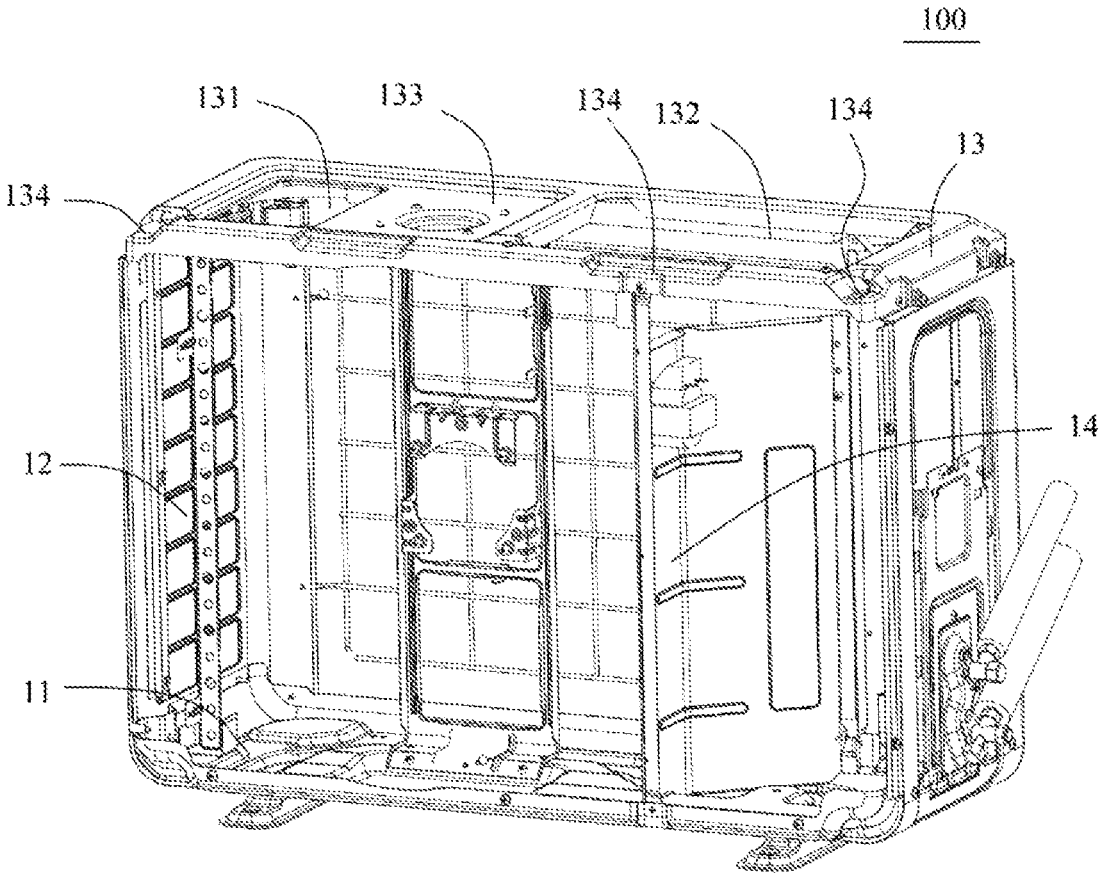
FIG. 1 is a schematic diagram illustrating a structure of an air-conditioning outdoor machine without a top cover according to an exemplary aspect of the present disclosure.
Figure 2:
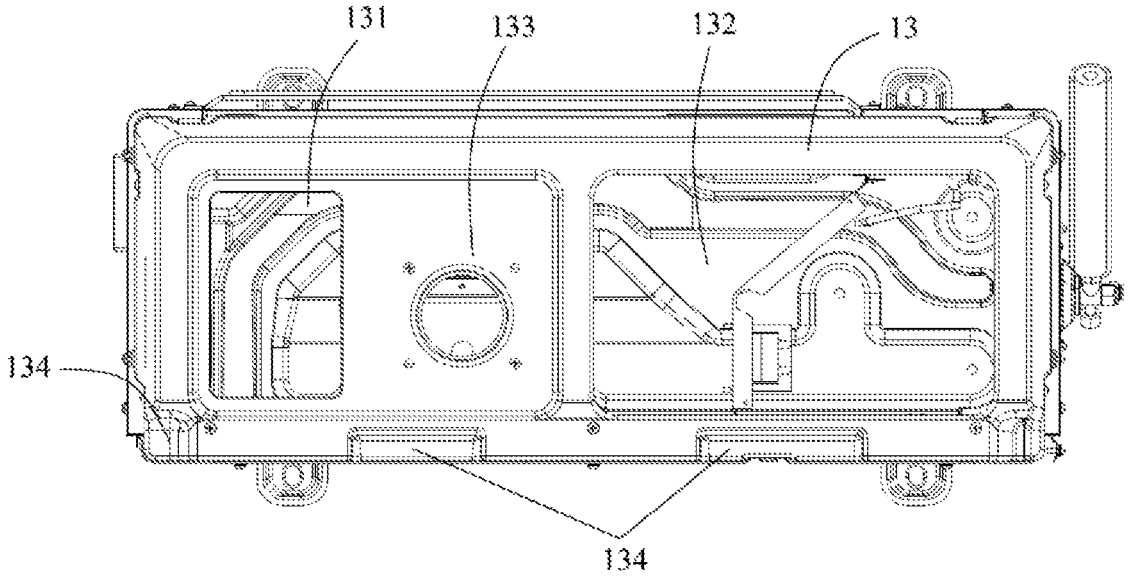
FIG. 2 is a top view illustrating the air-conditioning outdoor machine shown in FIG. 1 according to an exemplary aspect of the present disclosure.

FIG. 1 is a schematic diagram illustrating a structure of an air-conditioning outdoor machine without a top cover according to an example of the present disclosure. FIG. 2 is a top view illustrating the air-conditioning outdoor machine shown in FIG. 1. As shown in FIGS. 1 and 2, the air-conditioning outdoor machine 100 provided by examples of the present disclosure includes a bottom housing 11, a wall housing 12 enclosed on the bottom housing 11, a top sub-plate 13 provided at a top of the wall housing 12 and a top cover (not shown) removably mounted on the top sub-plate 13. The top sub-plate 13 is removably fixed on the wall housing 12 and the top cover is removably assembled onto the top sub-plate 13. The bottom housing 11, the wall housing 12 and the top sub-plate 13 define an accommodating space of an internal structure of the air-conditioning outdoor machine 100. The air-conditioning outdoor machine in the present disclosure is provided with the top sub-plate 13, so that the structure of the air-conditioning outdoor machine 100 is improved by the top sub-plate 13. In this way, the appearance of the air-conditioning outdoor machine 100 can be improved and thus maintenances can be further facilitated.

The wall housing 12 is formed by four side plates enclosed on the bottom housing 11. In an example, the wall housing 12 may be integrally formed by enclosing the four side plates, may also be integrally formed by enclosing part of adjacent side plates, or may be formed by splicing the four side plates. For example, three of the four side plates of the wall housing 12 may be integrally formed and another side plate may be removably fixed at the air-conditioning outdoor machine 100 with a screw, so that installation personnel or maintenance personnel can perform assembly or maintenance for the internal structure of the air-conditioning outdoor machine 100.

The top sub-plate 13 includes an observation window 131 in communication with the accommodating space. Installation personnel or maintenance personnel may directly see main components inside the air-conditioning outdoor machine 100 through the observation window 131, so that the installation personnel or the maintenance personnel can quickly know about the connections of the components inside the air-conditioning outdoor machine 100 or find out a routine problem inside the air-conditioning outdoor machine 100. During installation of the air-conditioning outdoor machine 100, the installation personnel may remove the top cover on the top sub-plate 13 and conveniently observe the connections of the internal components through the observation window 131. During maintenance of the air-conditioning outdoor machine 100, the maintenance personnel may remove the top cover and conveniently observe whether the internal components are damaged through the observation window 131 so as to reduce maintenance difficulty brought to the maintenance personnel. In an example, a position that is at the top cover and corresponds to the observation window 131 may be made with a transparent material, so that the installation personnel or the maintenance personnel can directly observe the components inside the air-conditioning outdoor machine 100 without removing the top cover.

In an example of the present disclosure, at least part of the observation window 131 is opposite to a fan inside the air-conditioning outdoor machine 100. In an example, the observation window 131 may be opposite to the fan and a condenser inside the air-conditioning outdoor machine 100 and a part of the bottom housing 11, so that the installation personnel or the maintenance personnel can directly observe a running state of the fan, a working state of the condenser and determine whether there is accumulated water on the bottom housing 11 and so on, which further facilitates operations of the installation personnel or the maintenance of the maintenance personnel.

In an example, to accommodate a cable connecting the air-conditioning outdoor machine with an air-conditioner, a cable control box may be provided at an external side surface of the wall housing of the air-conditioning outdoor machine. However, this designing manner will not only affect the appearance of the air-conditioning outdoor machine, but also cause rainwater to seep into the cable control box from the external side surface of the wall housing, due to outdoor environment such as windiness and insolation, thereby leading to potential safety hazards such as short circuit inside the cable control box. The top sub-plate 13 in the present disclosure may further include a cable-control-arrangement-structure 132 for accommodating a connecting cable. The top sub-plate is provide with the cable-control-arrangement-structure 132 (such as, the cable control box) to prevent rainwater from entering the cable-control-arrangement-structure. As shown in FIGS. 1 and 2, the observation window 131 and the cable-control-arrangement-structure 132 may be located on both ends of the top sub-plate 13 respectively. In an example, the cable-control-arrangement-structure 132 may be located above a compressor inside the air-conditioning outdoor machine 100. The cable-control-arrangement-structure 132 of the top sub-plate 13 may also accommodate redundant connecting wires inside the air-conditioning outdoor machine 100 as well as a cable connecting the air-conditioning outdoor machine with the air conditioner.

In an example, the cable-control-arrangement-structure 132 may be a recess depressed toward the bottom housing 11. In an example, the top sub-plate 13 may be of sheet metal structure. The cable-control-arrangement-structure 132 may be a recess formed by stamping sheet metal. In another example, the cable-control-arrangement-structure 132 may include an opening provided at the top sub-plate 13 and an accommodating box provided under the opening. The accommodating box may include a plastic box, which further avoids the risk of short circuit. Further, after being assembled on the top sub-plate 13, the top cover may achieve waterproofing effect for the cable-control-arrangement-structure 132. In addition, the cable-control-arrangement-structure 132 is provided inside the air-conditioning outdoor machine 100, thereby improving the appearance of the air-conditioning outdoor machine 100.

Further, the top sub-plate 13 may include a fan-support-assembling-region 133 for assembling a fan support structure. For example, the fan-support-assembling-region 133 may be located between the observation window 131 and the cable-control-arrangement-structure 132. The fan-support-assembling-region 133 may include a cooperating portion and a position-limited guiding portion close to the cooperating portion. The fan may be respectively coupled with the top sub-plate 13, the wall housing 12 and the bottom housing 11 through a carrying plate. The carrying plate may enter a preset assembly position by cooperating with the position-limited guiding portion and finally be cooperatively fixed with the cooperating portion. In the present disclosure, the stability of the internal structure of the air-conditioning outdoor machine 100 can be improved by assembling the carrying plate coupled with the fan into the fan-support-assembling-region 133.

In an example, at least one flow guiding groove 134 is provided at an edge of the top sub-plate 13. The flow guiding groove 134 may be used to drain rainwater out. The flow guiding groove 134 may be provided at a corresponding position to avoid the main components of the air-conditioning outdoor machine 100. In an example, a plurality of the flow guiding grooves 134 are respectively provided at a corner and a side edge of the top sub-plate 13.

In another example, a flow guiding plate (not shown) may be provided at a circumferential side of the top sub-plate 13, so that rainwater can directly flow out of the air-conditioning outdoor machine 100. The flow guiding plate may have a structure similar to a miniature awning so as to protect the air-conditioning outdoor machine 100.

The air-conditioning outdoor machine 100 may include a support structure 14 connected between the bottom housing 11 and the top sub-plate 13. The support structure 14 may be used to improve the strength of the air-conditioning outdoor machine 100. In an example, the support structure 14 may be a sheet metal plate and a space enclosed by the sheet metal plate, the bottom housing 11, the wall housing 12 and the top sub-plate 13 may be used for receiving a compressor, that is, a relatively closed space is provided for the compressor. This design may facilitate blocking noise of the compressor so that the air-conditioning outdoor machine 100 may generate relatively low noise during operation.

The air-conditioning outdoor machine in the present disclosure is improved by adding a top sub-plate. The top sub-plate has functions of observation and accommodating connecting wires and so on, which reduces costs, improves appearance and facilitates maintenance. Further, a support structure is added in the air-conditioning outdoor machine to increase stiffness and strength of the air-conditioning outdoor machine and improve the quality.

After considering the specification and practicing the present disclosure, the persons of skill in the art may easily conceive of other implementations of the present disclosure. The present disclosure is intended to include any variations, uses and adaptive changes of the present disclosure. These variations, uses and adaptive changes follow the general principle of the present disclosure and include common knowledge or conventional technical means in the prior art not disclosed in the present disclosure. The specification and examples herein are intended to be illustrative only and the real scope of the present disclosure are indicated by the claims of the present disclosure.

It is to be understood that the present disclosure is not limited to the precise structures described above and shown in the accompanying drawings and may be modified or changed without departing from the scope of the present disclosure. The scope of protection of the present disclosure is limited only by the appended claims.

What is claimed is:

1. An air-conditioning outdoor machine, comprising:

a bottom housing;

a wall housing enclosed by the bottom housing;

a top sub-plate provided at a top of the wall housing;

a top cover removably mounted on the top sub-plate; and at least one flow guiding groove configured to drain rainwater and provided at an edge of the top sub-plate, wherein the bottom housing, the wall housing, and the top sub-plate define an accommodating space of an internal structure of the air-conditioning outdoor machine, wherein the top sub-plate comprises an observation window that is different from the at least one flow guiding groove and that is configured to provide a view of the accommodating space, wherein at least part of the observation window is opposite to a fan inside the air-conditioning outdoor machine, wherein the top sub-plate comprises a cable-control-arrangement-structure configured to accommodate connecting wires, the cable-control-arrangement-structure being an accommodating recess depressed toward the bottom housing, and wherein the observation window and the cable-control-arrangement-structure are located on opposite ends of the top sub-plate, respectively.

2. The air-conditioning outdoor machine according to claim 1, wherein the top sub-plate further comprises a fan-support-assembling-region for assembling a fan support structure, and wherein the fan-support-assembling-region is located between the observation window and the cable-control-arrangement-structure.

3. The air-conditioning outdoor machine according to claim 2, wherein the fan-support-assembling-region comprises a cooperating portion and a position-limited guiding portion close to the cooperating portion.

4. The air-conditioning outdoor machine according to claim 1, wherein the at least one flow guiding groove comprises a plurality of flow guiding grooves that are respectively provided at a corner and a side edge of the top sub-plate.

5. The air-conditioning outdoor machine according to claim 1, wherein the air-conditioning outdoor machine further comprises a support structure connected between the bottom housing and the top sub-plate.

6. The air-conditioning outdoor machine according to claim 5, wherein the support structure is a sheet metal plate.

7. The air-conditioning outdoor machine according to claim 5, wherein the support structure, the bottom housing, the wall housing, and the top sub-plate define a space for accommodating a compressor.

8. The air-conditioning outdoor machine according to claim 1, wherein a position that is at the top cover and corresponds to the observation window is made with a transparent material.

* * * * *